United States Patent [19]

Goettl

[11] 4,199,302

[45] Apr. 22, 1980

[54] CENTRIFUGAL BLOWER HAVING IMPROVED STRUCTURE FOR MOUNTING OF ROTOR ASSEMBLY

[76] Inventor: Adam D. Goettl, 4960 E. Palomino Dr., Phoenix, Ariz. 85018

[21] Appl. No.: 4,928

[22] Filed: Jan. 19, 1979

Related U.S. Application Data

[60] Division of Ser. No. 749,675, Dec. 13, 1976, which is a continuation-in-part of Ser. No. 639,521, Dec. 10, 1975, abandoned.

[51] Int. Cl.[2] ..... F04D 29/42

[52] U.S. Cl. ..... 415/201; 415/206; 415/219 C; 308/15; 308/72

[58] Field of Search ..... 417/362, 363, 423 R; 415/201, 206, 219 C, 98; 308/26, 114

[56] References Cited

U.S. PATENT DOCUMENTS

| | | | |
|---|---|---|---|
| 1,700,074 | 1/1929 | Rathbun | 308/114 |
| 2,700,500 | 1/1955 | Wren | 248/637 |
| 2,722,464 | 11/1955 | Galaba | 308/72 X |
| 2,830,752 | 4/1958 | Wentling | 416/178 |
| 2,975,961 | 3/1961 | Rodick | 417/362 |
| 3,058,650 | 10/1962 | Meyer et al. | 415/206 X |
| 3,255,957 | 6/1966 | Laing | 415/54 |
| 3,332,612 | 7/1967 | Gross | 415/206 |
| 3,698,833 | 10/1972 | Cann et al. | 415/201 |
| 3,746,464 | 7/1973 | Goettl | 417/423 R |
| 3,775,029 | 11/1973 | Ranz | 415/219 C |

*Primary Examiner*—Leonard E. Smith
*Attorney, Agent, or Firm*—Herbert E. Haynes, Jr.

[57] ABSTRACT

A centrifugal blower assembly including a blower wheel rotatably journaled within a housing on easily fabricated low-cost rotor support braces which are designed to provide rigid versatile structures which may be combined with an especially configured blower housing to improve serviceability of the assembly.

8 Claims, 13 Drawing Figures

CENTRIFUGAL BLOWER HAVING IMPROVED STRUCTURE FOR MOUNTING OF ROTOR ASSEMBLY

CROSS-REFERENCE TO RELATED APPLICATION

This application is a divisional application of copending U.S. patent application Ser. No. 749,675, filed Dec. 13, 1976, which in turn is a continuation-in-part of U.S. patent application Ser. No. 639,521, filed Dec. 10, 1975, now abandoned, all by the same inventor.

BACKGROUND OF THE INVENTION

1. Field of the Invention

This invention relates to air handling equipment and more particularly to a centrifugal blower assembly.

2. Description of the Prior Art

In the field of air handling equipment, centrifugal blower assemblies have long been employed for uses such as ventilation, fume exhaust, material handling, and the like. Blower assemblies have been designed in almost every conceivable size, volumetric output capacity and pressure range. Also, these blowers have been constructed in down-draft, side-draft, up-draft, and various other angular configurations. However, regardless of the application and the above described variables, centrifugal blower assemblies are all provided with the same basic components and operate in the same basic manner.

In general, the prior art centrifugal blower assemblies comprise a spiral-shaped housing normally fabricated of sheet metal and welded into a one piece structure. The housing is provided with an air inlet opening formed in at least one of the spaced side walls, and a centrifugal outlet through which exhaust air is expelled. An air moving rotor or impeller is positioned within the housing along the axis of the air inlet openings. The rotor is demountably carried on an axle shaft and is rotatably movable therewith. The ends of the axle shaft extend laterally from opposite ends of the hub of the rotor and are journaled for rotation in bearings carried centrally within the air inlet openings by suitable braces.

Driving of the rotor is usually accomplished by a suitable drive means, such as an electric motor, which is directly coupled to the axle shaft either by a gear drive assembly or a pulley belt arrangement. An alternate method of driving the rotor is to provide a belt driven pulley on the periphery of the rotor. Such a drive system is fully disclosed in U.S. Pat. No. 3,702,741, issued on Nov. 14, 1972 to the same inventor.

Optimum air handling characteristics dictate that the diameter of the air inlet openings in the centrifugal blower housing be less than the diameter of the rotor. Due to this and the one piece construction of the housing, it will be seen that installation and removal of the rotor can only be accomplished through the centrifugal outlet of the blower housing, and such movements cannot be accomplished with the axle shaft assembled thereto due to the laterally extending ends thereof. Thus, the length of the axle shaft necessitates that it be removed or installed by axially sliding it through one of the air inlet openings.

Thus, with the centrifugal outlet being the only opening in the blower housing that is large enough for the rotor to pass through, it will be seen that servicing problems will result in many instances. To illustrate that problem, consider that in almost every instance, installation of a centrifugal blower assembly is accomplished by supportingly positioning the assembly adjacent a horizontal or vertical structure, such as the roof or wall of a building, and connecting the centrifugal outlet to the building's duct work. To install or remove a rotor from a blower assembly mounted in that fashion requires that the entire assembly be removed from the supporting structure and from the ducts to which it is connected in order to gain access to the centrifugal outlet.

This problem of access is more serious in centrifugal blower assemblies of the type in which the rotor is peripherally driven, i.e., a drive belt engages a pulley disposed on the periphery of the rotor. The simple act of changing a belt or other servicing of such assemblies is extremely difficult due to the air inlet openings being smaller than the periphery of the rotor.

One solution to the above discussed problems relating to access is fully disclosed in U.S. Pat. No. 3,746,464, issued to the same inventor on July 17, 1973. In the structure disclosed in that patent, the spiral-shaped portion of the blower housing is formed with a removable segment which, when removed, provides an access opening into the interior of the housing for servicing purposes and through which the rotor can be passed. This particular structure however, cannot be employed in all instances to solve the access problem. For example, when the centrifugal blower assembly is mounted within a conventional evaporative cooler housing, the cooler housing itself is often disposed proximate the spiral-shaped portion of the blower housing in such close relationship that removal of the removable segment cannot be accomplished.

Other problems exist with regard to centrifugal blower assemblies; namely, the cost of fabrication and the corrosive environment in which such assemblies oftentimes operate.

Since the rotor of a centrifugal blower is a rotating structure, such factors as rotor balance, precision alignment of the rotor hub, axle and bearings and rotor support braces are critical. If those factors of balance and alignment are imperfectly achieved the result will be an inefficient and noisy assembly. Therefore, fabrication of a quiet and efficient centrifugal blower assembly is a relatively costly project.

The cost of such assemblies is further aggrevated when the centrifugal blower is to be employed in a corrosive environment such as in an evaporative cooler. In such instances, the axle, rotor, hubs, bearing and the like must be fabricated of materials which retard corrosion, and an efficient lubrication system must be employed.

Therefore, a need exists for a new and useful centrifugal blower assembly which overcomes some of the problems of the prior art.

SUMMARY OF THE INVENTION

In accordance with the present invention, a novel rotor mounting arrangement is combined with an especially configured blower housing to provide a new and useful centrifugal blower assembly.

The centrifugal blower housing has an air inlet opening formed in at least one of the opposed side walls thereof. In blower structures having an air inlet opening formed in each of the side walls, a pair of rotor support brace means are each mounted to a different one of the side walls so as to span the air inlet opening thereof.

Each of the rotor support brace means are of special construction and may be formed in either of two configurations as determined by the method employed to mount the rotor.

In the first rotor mounting method to be described, each of those rotor support brace means includes a fixed stub shaft which extends therefrom coaxially through the air inlet opening of the side wall on which it is mounted into the interior of the blower housing. In blower housings having a single air inlet opening, a single rotor support brace means, as described above, is employed to position the stub shaft thereof coaxially in the inlet opening, and another stub shaft is suitably carried on the opposite side wall so as to axially align with the stub shaft carried by the rotor support brace means.

In the second rotor mounting method, each of the rotor support brace means includes a bearing for receiving the axle shaft carried by the rotor in any of several well known manners. In blower housings having a single air inlet opening, the single brace is employed to centrally support the bearing in the air inlet opening, and the other bearing is suitably mounted in the opposite side wall of the blower housing.

The centrifugal blower assembly of the present invention may be provided with a removable access panel on one or both sides of the blower housing so that rotor replacement and/or other servicing can be accomplished through the side of the blower housing.

Accordingly, it is an object of the present invention to provide a new and useful centrifugal blower assembly.

Another object of the present invention is to provide a new and useful centrifugal blower assembly the rotor of which is supported on especially configured rotor support braces.

Another object of the present invention is to provide a new and useful centrifugal blower assembly the rotor of which is journaled for rotation about a fixed pair of axially spaced stub shafts with those shafts being carried in especially configured rotor support braces.

Another object of the present invention is to provide a new and useful centrifugal blower assembly having a pair of rotor support braces each demountably attached to a different one of the opposed side walls of the blower housing with those braces each having a stub shaft extending therefrom coaxially through the air inlet openings into the interior of the blower housing for supporting a rotor thereon, with the rotor journaled for rotation about the stub shafts.

Another object of the present invention is to provide a new and useful centrifugal blower assembly the rotor of which is provided with axle means rotatable therewith, with the axle means journaled for rotation in an axially spaced pair of bearings carried in especially configured rotor support braces.

Another object of the present invention is to provide a new and useful centrifugal blower assembly having a spaced pair of especially configured rotor support braces each demountably attached to a different one of the side walls of the blower housing with those braces each having a bearing therein for rotatably journaling the axle means of the rotor within the blower housing.

Another object of the present invention is to provide a new and useful centrifugal blower assembly having an especially configured blower housing which facilitates servicing and/or replacement of the rotor.

Still another object of the present invention is to provide a new and useful centrifugal blower assembly of the above described character which is serviceable through the side wall of the blower housing by removing an attached access panel means which enlarges the axial air inlet in the side wall of the blower housing.

Yet another object of the present invention is to provide a new and useful centrifugal blower assembly which includes especially configured rotor support braces one of which is affixed to an access panel demountably carried on one side wall of the centrifugal blower housing.

The foregoing and other objects of the present invention, the various features thereof as well as the invention itself, may be more fully understood from the following description when read in conjunction with the accompanying drawings.

DESCRIPTION OF THE PREFERRED EMBODIMENTS

Figure 1:
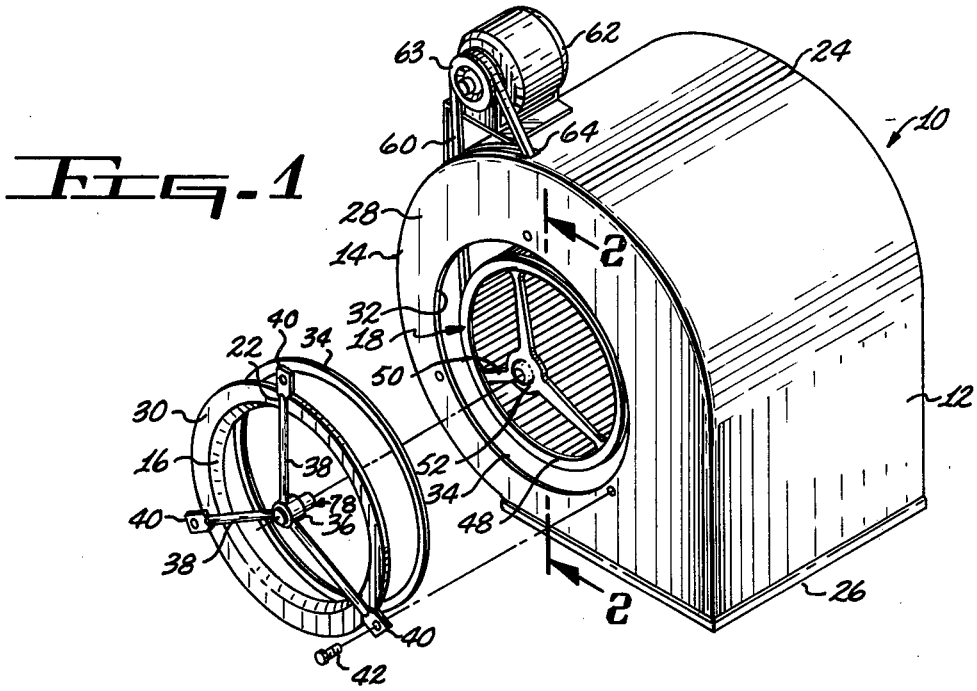
FIG. 1 is an isometric view partially exploded to show the various features of one embodiment of the centrifugal blower assembly of the present invention.

Referring more particularly to the drawings, FIG. 1 illustrates one type of centrifugal blower assembly which is indicated generally by the reference numeral 10. It should be understood that the blower assembly 10 as illustrated is not intended as a limitation to the present invention. The blower assembly 10 is shown as a dual inlet down-draft model having other specific details of design which were chosen merely for illustrative purposes.

As shown, the centrifugal blower assembly 10 includes a housing 12 having a pair of vertically disposed spaced apart side walls 14 and 15. The side walls 14 and 15 are provided with air inlet openings 16 and 17, respectively, and those openings are in axial alignment with each other as is customary in such structures. A rotatable air moving rotor 18 is positioned between the air inlet openings 16 and 17 of the side wall 14 and 15 and is carried in axiallalignment with those openings by a rotor support brace 20 mounted on the side wall 15 and an identical rotor support brace 22 carried on the side wall 14, as will hereinafter be described in detail.

The blower housing 12 of the centrifugal blower assembly 10 further includes a spiral-shaped surface 24 which is positioned to extend between the side walls 14 and 15. As is well known in the art, air is drawn into the interior of the blower housing 12 through the axial air inlets 16 and 17 upon rotation of the rotor 18, and that air is expelled from the blower housing through the centrifugal outlet 26 thereof.

As is also well known, one of the factors which helps to achieve optimum air handling characteristics in a centrifugal blower is to have the diameter of the air inlets somewhat smaller than the diameter of the rotor, and as shown, such is the case in the centrifugal blower assembly 10 of the present invention.

Figure 2:
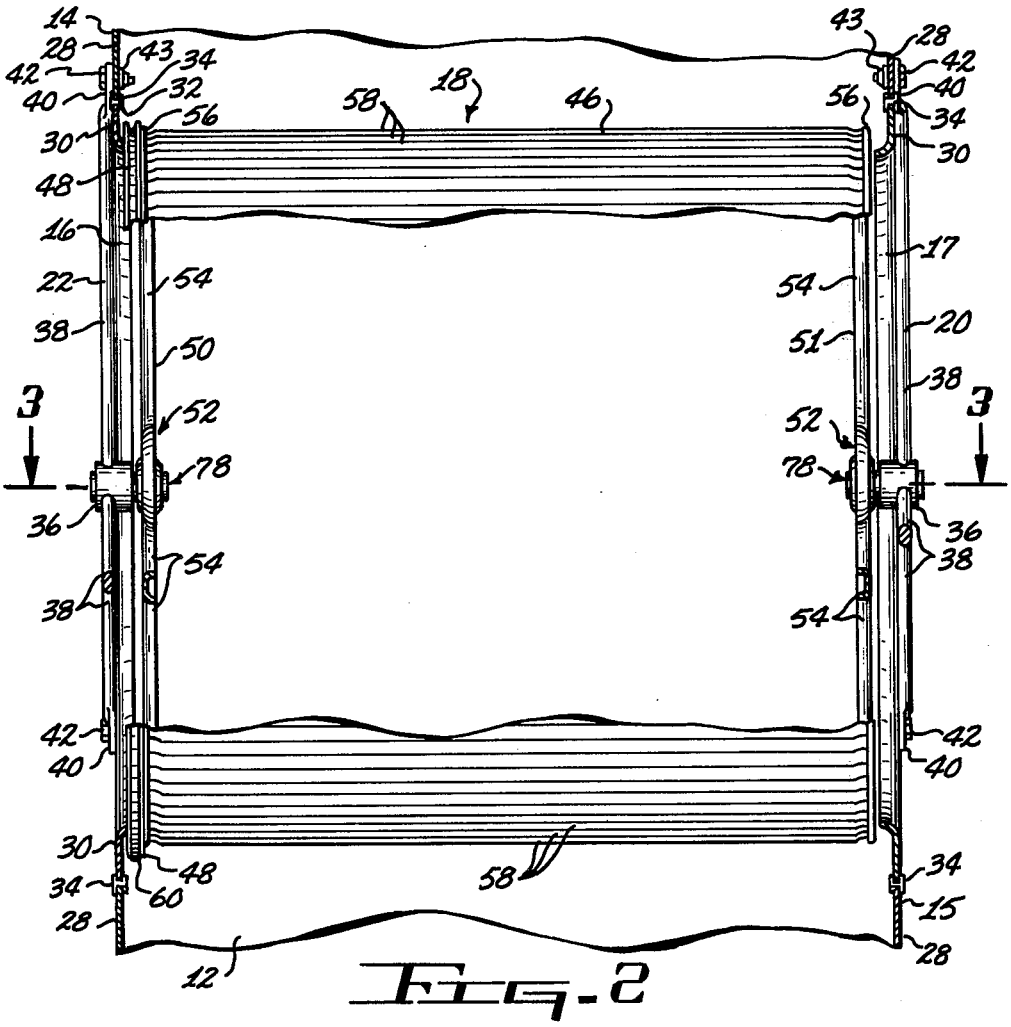
FIG. 2 is an enlarged fragmentary sectional view taken on the line 2—2 of FIG. 1.

As shown in FIG. 2, the side walls 14 and 15 of the blower housing 12 are each especially fabricated as two piece structures, as will be described below, and each of these side walls is identical, therefore, the following description of the side wall 14 will be understood to also apply to the side wall 15.

In accordance with the present invention, the side wall 14 of the blower housing 12 is especially fabricated as a two piece assembly which includes the fixed panel 28 having an access panel means 30 demountably attached thereto. The fixed panel 28 of the side wall 14 is substantially conventional with the exception that an access opening 32 is formed therethrough as best seen in FIG. 1. The access opening 32 has a diameter that is somewhat larger than the diameter of the rotor 18 thus enabling the rotor to be installed or removed through that opening 32, and also facilitates other servicing of the centrifugal blower assembly 10. The access panel means 30 is a substantially flat ring shaped panel the outside diameter of which is sized to fit into the access opening 32 of the panel 28, and the inside diameter of which circumscribes the properly formed and sized air inlet opening 16.

Therefore, it may now be seen that with the access panel means 30 removed from the side wall 14 of the blower housing 12, the above described access to the interior of the blower housing 12 is provided through the access opening 32, and with the access panel means 30 attached to the side wall 14, the blower housing is provided with the proper axial air inlet opening 16 needed for optimum operation.

The demountable attachment of the access panel means 30 in the access opening 32 of the fixed panel 28 to form the complete side wall 14 may be accomplished in various ways such as by affixing radially extending ears (not shown) on the access panel and securing those ears to the fixed panel 28 such as with sheet metal screws (not shown). However, it is preferred that the access panel means 30 be affixed to the rotor support brace 22, such as by welding, so that both the brace 22 and the access panel means 30 can be simultaneously removed as will hereinafter be described in detail.

It is preferred that the side wall 14 be fabricated as a two piece structure by a blanking operation which forms the access opening 32 and allows the piece removed by that operation to be used as the access panel 30. The edge which circumscribes the access opening is turned inwardly to form an annular flange 31 which provides rigidity and the resulting gap is closed by a suitable annular gasket 34. TThe gasket 34 is mounted on the periphery of the access panel 30 and provides a rattle free air tight seal.

It should be noted that although both of the side walls 14 and 15 are shown as being fabricated as two piece structures, one or the other of those side walls could be conventionally fabricated as a one piece structure (not shown) if access for servicing purposes is only needed from one side of the centrifugal blower housing 12.

Further, some centrifugal blower assemblies are formed with a single air inlet opening, therefore, one or the other of the side walls 14 and 15 of the housing 12 could be fabricated without an air inlet opening therein.

As hereinbefore mentioned, the rotor support braces 20 and 22 of the embodiment shown in FIGS. 1 through 8, are identical, thus, the following description of brace 22 will be understood to also apply to brace 20. The brace 22 has a central hub 36 from which struts 38 radially extend. The struts 38 of this embodiment are preferrably three in number and each have a mounting pad 40 on the extending end thereof, with those mounting pads being adapted for demountable attachment to the side wall 14 of the blower housing 12. The mounting may be accomplished such as with suitable bolts 42 which pass through the mounting pads 40, through the side wall 14, and threadingly engage nuts 43 captively fixed on the interior surface of the side wall 14. As will hereinafter be described in detail, each of the rotor support braces 20 and 22 are provided with a stub shaft assembly 78 which extend axially from their respective hubs 36 into the interior of the blower housing 12.

It may now be seen that with the rotor support braces 20 and 22 demountably attached to the side walls 14 and 15 and with the access panel means 30 affixed to the braces as described above, access to the interior of the centrifugal blower assembly 10 for servicing purposes can be achieved simply by removing the three bolts 42 which attach one or the other of the braces 20 and 22 and simultaneously removing that brace and the access panel means 30 attached thereto.

For reasons which will become readily apparent as this description progresses, the rotor assembly 18 employed in the centrifugal blower assembly 10 of the present invention is preferrably of the type sometimes referred to as a peripherally driven rotor. Thus, the rotor assembly 18 includes a blower wheel 46 having a suitable pulley 48 provided on the periphery thereof. It should be noted that the specific pulley-wheel arrangement shown is not intended as a limitation of the present invention as that specific arrangement is intended to show one type of such structure which is usuable in the apparatus of the present invention.

The construction details of the specific pulley 48 shown and the manner of attaching that pulley to the blower wheel 46 are fully disclosed in U.S. Pat. No. 3,702,741, issued on Nov. 14, 1972 to the same inventor. Therefore, those details will only be briefly discussed herein.

The blower wheel 46 is of generally conventional design having a pair of axially spaced support plates 50 and 51 located at the opposite ends of the wheel. In accordance with the present invention, the support plates 50 and 51 are each provided with a special hub assembly 52 as will hereinafter be described in detail. The hub assemblies 52 each have the usual integrally formed spokes 54 radially extending therefrom with those spokes terminating at their outermost ends in integrally formed annular rings 56. The usual plurality of impeller blades 58 are positioned between the annular rings 56 and are connected thereto by techniques well known in the art.

The pulley 48 is suitably affixed, as disclosed in the above referenced U.S. Patent, to the annular ring 56 of the support plate 50 which positions the pulley for engagement with a drive belt 60.

As seen best in FIG. 1, rotation of the rotor assembly 18 is accomplished by a suitable drive means 62 illustrated in the form of an electric motor having a drive pulley 63 over which the belt 60 passes. A slot 64 is provided in the spiral shaped surface 24 of the blower housing 12 so that belt 60 extends therethrough into engagement with the pulley 63 of the drive means 62 and the pulley 48 of the rotor assembly 18.

Figure 3:
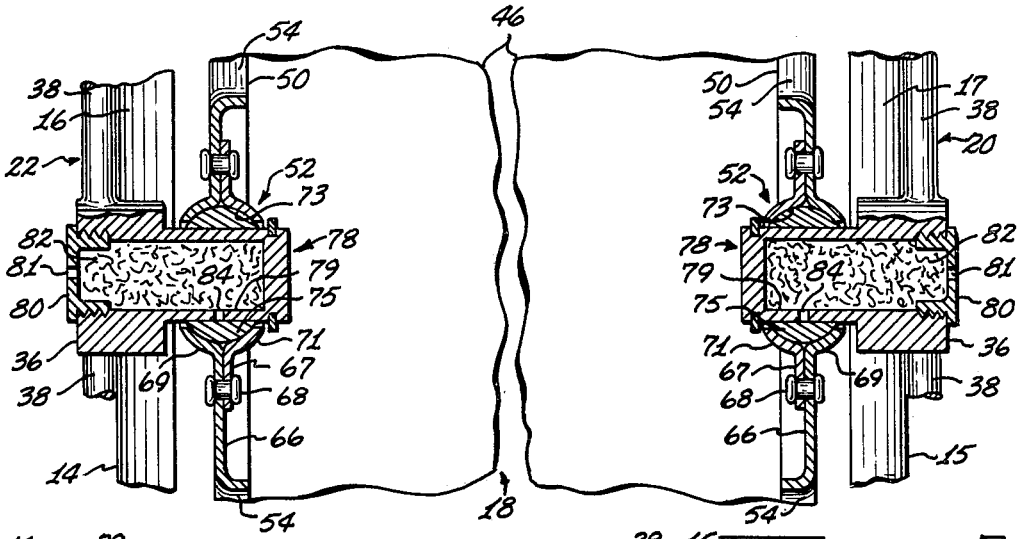
FIG. 3 is an enlarged fragmentary sectional view taken on the line 3—3 of FIG. 2.

Reference is now made to FIG. 3 wherein one of the rotor mounting arrangements of the present invention is best seen. It will be noted that the mounting of the support plates 50 and 51 of the blower wheel 46 on the stub shafts 78 of their respective rotor support braces 20 and 22 is identical, thus the following description and mounting of the support plate 50 on the stub shaft 78 of the rotor support brace 22 will be understood to also apply to the description and mounting of plate 51 on the stub shaft 78 of the brace 20.

The hub assembly 52 of the blower wheel support plate 50 is provided with a substantially circular outer plate 66 from the periphery of which the integrally formed spokes 54 extend. A circular inner plate 67 of smaller diameter is suitably affixed to the inner surface of the outer plate 66 such as with rivets 68. At the center of the outer plate 66, an outwardly upset semicircular portion 69 is stamped or otherwise formed, and that portion has an axial aperture formed therethrough. A similar inwardly upset semicircular portion 71 is formed centrally of the inner plate 67 and it also has an axial aperture formed therethrough. With the inner and outer plates 66 and 67 affixed together as described above, the semicircular portions 69 and 71, respectively thereof, form a cavity 73 which has its inwardly facing surface, that circumscribes the axis of the blower wheel, configured to be arcuate in cross section, and the cavity is adapted to retain bearing means 75 therein. The bearing means 75, shown in the form of a bushing having the usual axial bore formed therethrough and has its peripheral surface configured to be arcuate in cross section so that the bearing means 75 is nestingly seated within the cavity 73 and is held therein against rotation relative to the blower wheel 46. The arcuate shapes of the inner surface of the cavity 73 and the periphery of the bearing means 75 permits the bearing means to be moved in a swivel motion relative to the hub assembly 52 of the support plate 50 as will hereinafter be described in detail.

The previously mentioned stub shaft assemblies 78 are fast with their respective rotor support braces 20 and 22 and extend therefrom coaxially through the air inlet openings 16 and 17 of the blower housing 12 and are positioned within the axial bores of the bearing means 75 provided in the rotor assembly 18. Therefore, with the stub shaft assemblies 78 fast with their respective braces 20 and 22 and the bearing means 75 fixed against rotation relative to the rotor assembly 18, it will be readily apparent that the rotor assembly is journaled for rotation about the stub shafts. It may also be apparent that axial misalignments which may occur within the rotor assembly itself, or between the rotor assembly and the support braces 20 and 22, will not interfere with assembling or operation of the centrifugal blower assembly 10, as such misalignments, unless extremely severe, can be compensated for due to the swivel movement capability of the bearing means 75 as described above.

The stub shaft assemblies 78 in this embodiment of the invention are formed integrally with their respective braces 20 and 22 such as by casting, and each are provided with an axial bore 79 that is closed at the inwardly facing end and open at the opposite end. The open ends of the axial bores 79 each have a removable closing means therein such as a plug 80 having an aperture 81 formed therein. A suitable lubrication retaining material 82, such as felt, is contained within the bores 79 of the shafts 78. The material 82 is saturated with a suitable lubricant such as oil, through the apertures 81 provided in the plugs 80, and the oil is dispensed to the bearing means 75 through radial apertures 84 formed in the shafts 78 so as to communicate between the bores 79 and the peripheral surfaces thereof.

Figure 4:
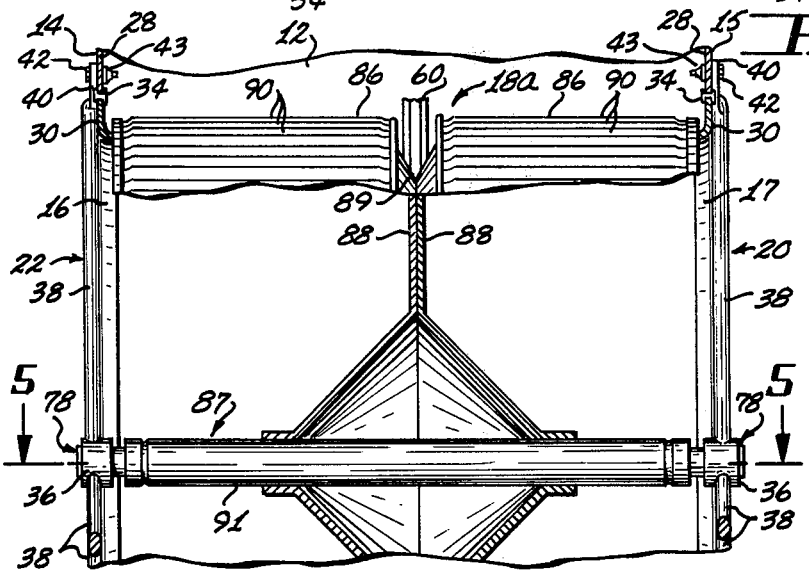
FIG. 4 is a fragmentary sectional view similar to FIG. 2 and illustrating a modification of the centrifugal blower assembly of the present invention.
Figure 6:
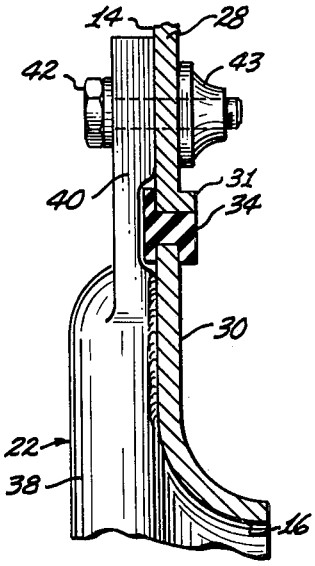
FIG. 6 is an enlarged fragmentary sectional view showing the attachment of an access panel means to the blower housing of the centrifugal blower of the present invention.
Figure 5:
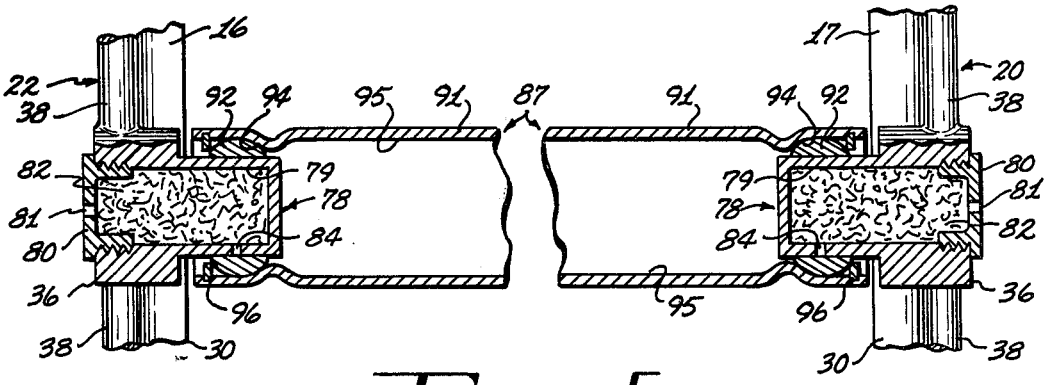
FIG. 5 is an enlarged fragmentary sectional view taken on the line 5—5 of FIG. 4.

Reference is now made to FIGS. 4 and 5 wherein the rotor mounting arrangement of the present invention is shown as having been modified to accommodate a different type of rotor assembly which is indicated generally by the reference numeral 18*a*. The rotor assembly 18*a* is formed of a pair of center suspended blower wheels 86 which are identical and are mounted in a back to back relationship on an axially disposed hub assembly 87. The blower wheels 86 each have a support plate 88 with those support plates welded or otherwise affixed to each other and configured at their respective peripheries to cooperatively form a V-shaped annular groove 89 which serves as a pulley for engagement by the drive belt 60. The plurality of impeller blades 90 provided on each of the blower wheels 86 are mounted in cantilever fashion on their respective support plates 88 as is well known in the art.

The hub assembly 87 to which the blower wheels 86 are attached is in the form of a tubular shaft 91 having a bearing means 92 mounted in each of its opposite ends. The bearing means 92 is similar to the previously described bearing means 75 in that its periphery is arcuate in cross section so that the bearing means 92 are nestingly seated within their respective opposite ends of the tubular shaft 91. The mounting of the bearing means 92 is accomplished by providing a cavity in each end of the shaft with those cavities partially enclosed by arcuate in cross section shoulders 94 within the bore 95 of the tubular shaft 91. The bearing means 92 are held in engagement with their respective shoulders 94 by a suitable retaining means such as a snap ring 96. Thus, the bearing means 92 are held against rotation relative to the tubular hub assembly 87 and are capable of swivel movement within the tubular hub 87 are hereinbefore described in detail with reference to the bearing means 75 being mounted in the rotor assembly 18.

The stub shaft assemblies 78 of this embodiment of the present invention are identical to the previously described stub shaft assemblies 78 and are therefore fast with their respective rotor support braces 20 and 22, and are adapted to lubricate the bearing means 92.

Figure 7:
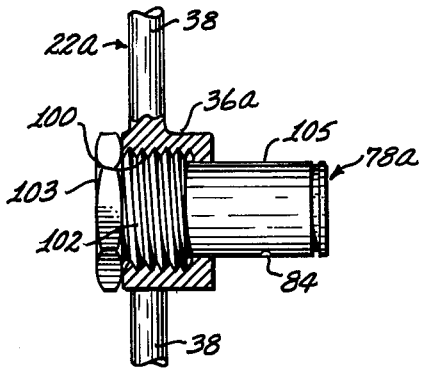
FIG. 7 is a fragmentary sectional view showing demountable attachment of the stub shafts to the rotor support brace means.
Figure 8:
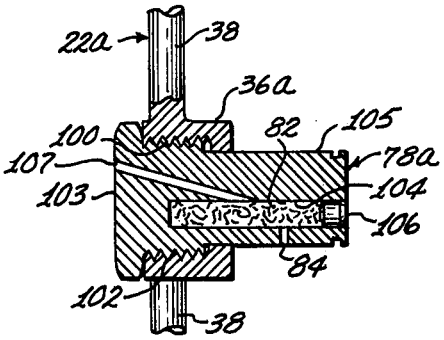
FIG. 8 is a view similar to FIG. 7 and illustrating the structural details of the stub shaft of that embodiment of the present invention.

Reference is now made to FIGS. 7 and 8 wherein it is shown that instead of forming the stub shafts integral with the rotor support braces such as by the previously described casting technique, the same objectives can be accomplished by employing another technique which results in an additional capability of the centrifugal blower assembly 10 of the present invention.

In this embodiment, the rotor support brace 22a, (the opposite rotor support brace although not shown is identical), is provided with an axially disposed threaded bore 100 formed in the hub 36a thereof for threadingly receiving the stub shaft assembly 78a therein. The stub shaft assembly 77a is formed with a threaded portion 102 and an enlarged head 103 so that the stub shaft 78a is demountably affixed to the rotor support brace 22a. The stub shaft 78a is formed with a bore 104 for containing the lubrication retaining material 82 which contains a suitable lubricant that is dispensed through the radial aperture 84 to the bearing surface 105 of the shaft. The bore 104 is closed at its open end such as with a plug 106, and the lubricant is supplied thereto through an angularly disposed passage 107 which opens through the enlarged head 103.

It will now be appreciated that the centrifugal blower assembly 10 of the present invention provides servicing and/or rotor passing capabilities through either side of the blower housing 12 by simply removing one or the other of the rotor support braces 20 or 22 with the attached access panel means 30. In addition to those capabilities it may be seen that by removing both of the rotor support braces 20 and 22, the rotor assembly 18 will be free from the stub shafts 78 so that if desired, the rotor may be removed through the centrifugal outlet 26, or through a removable segment (not shown) of the spiral shaped surface 24 of the blower housing if that housing is configured in accordance with the disclosure of the hereinbefore referenced U.S. Pat. No. 3,746,464. This latter method of installing or removing the rotor may be accomplished without removal of the rotor support braces when those braces have the stub shafts 78a threadingly affixed thereto in accordance with the disclosure of FIGS. 7 and 8.

Figure 9:
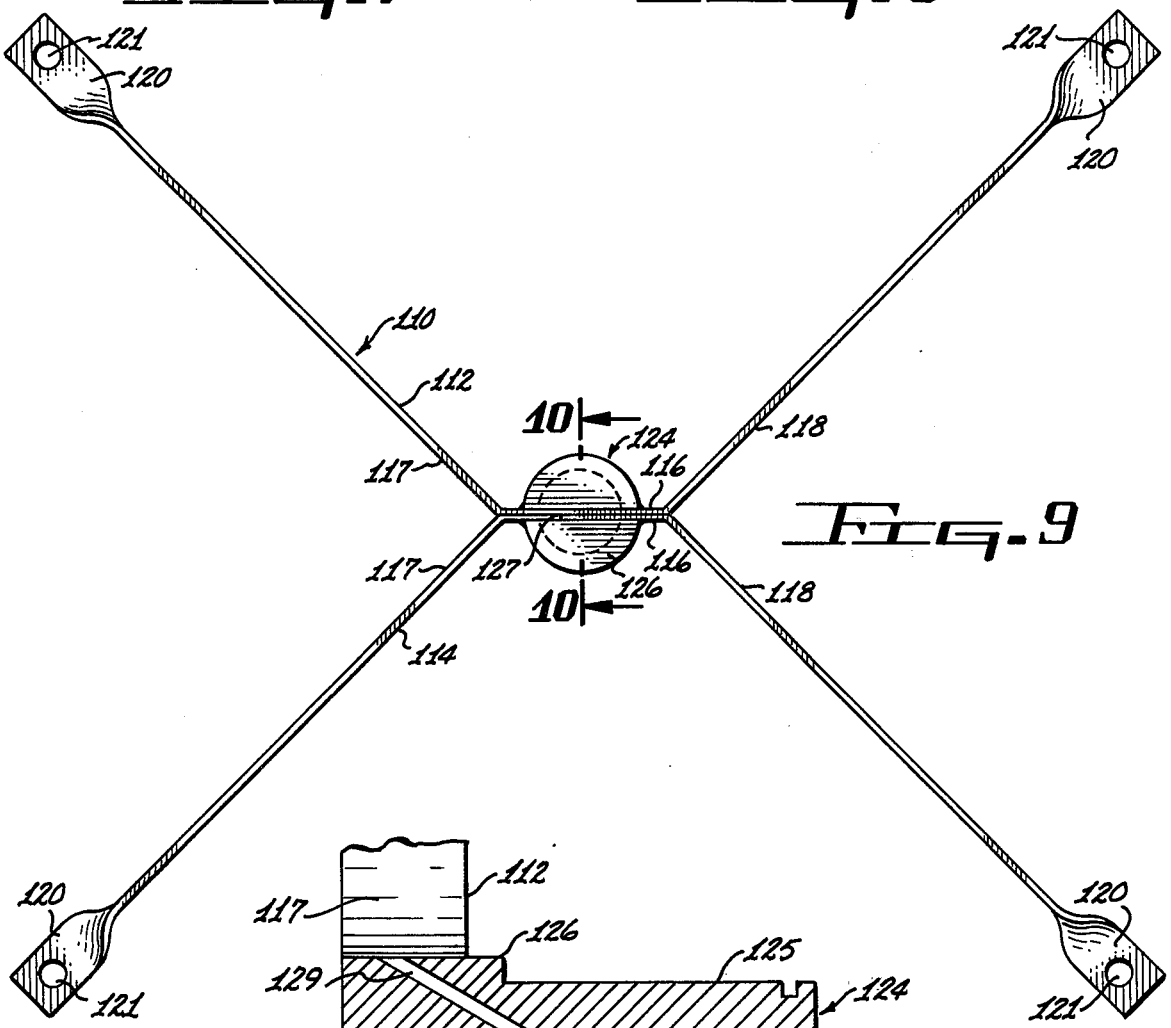
FIG. 9 is a side view of a preferred configuration of a rotor support brace suitable for use in the centrifugal blower assembly of the present invention.
Figure 10:
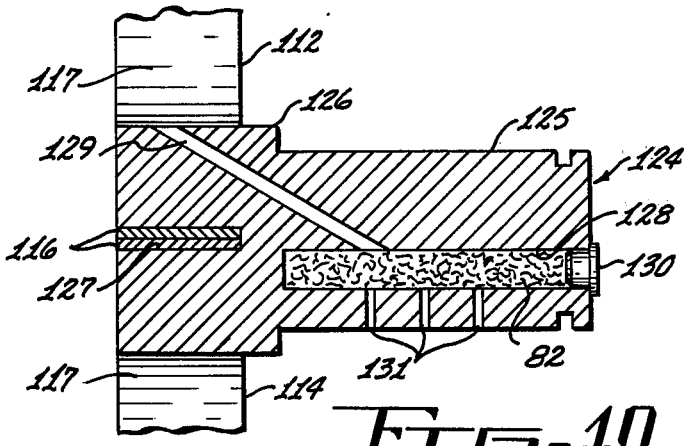
FIG. 10 is an enlarged fragmentary sectional view taken on the line 10—10 of FIG. 9.

FIGS. 9 and 10 illustrate still another modification which may be employed in the centrifugal blower assembly 10 of the present invention. This embodiment discloses a low cost easily fabricated preferred form of rotor support brace 110 formed of an upper strap member 112 and a lower strap member 114. The strap members 112 and 114 are identical and are each provided with a flat portion 116 integral with and intermediate a pair of oppositely angularly diverging strut portions 117 and 118. The extending ends of the strut portions are each twisted approximately 90 degrees to form a mounting pad 120 thereon with each of the pads 120 having an aperture 121 formed therethrough. The strap members 112 and 114 are positioned so that their respective flat portions 116 are in abutting engagement with each other so that the strut portions extend radially from the abutting flat portions 116.

A stub shaft assembly 124 is suitably affixed to the rotor support brace 110 such as by welding, and the shaft 124 is disposed to extend laterally from the abutting flat portions 116 of the strap members 112 and 114. The stub shaft 124 is a cylindrical structure having an extending portion 125, the periphery of which is the bearing surface of the shaft, and having an enlarged head 126 on one end thereof. An axially disposed transverse slot 127 is formed in the head 126 of the shaft 124 with the slot 127 being adapted to receive the abutting flat portions 116 of the rotor support brace 110 therein. The stub shaft 124 is provided with a bore 128 therein for containing the lubrication retaining material 82 which retains a suitable lubricant that is supplied thereto through an angular passage 129. The bore 128 is closed at its open end by a suitable plug 130, and the lubricant contained in the material 82 is dispensed through radial apertures 131 to the bearing surface of the shaft.

Figure 11:
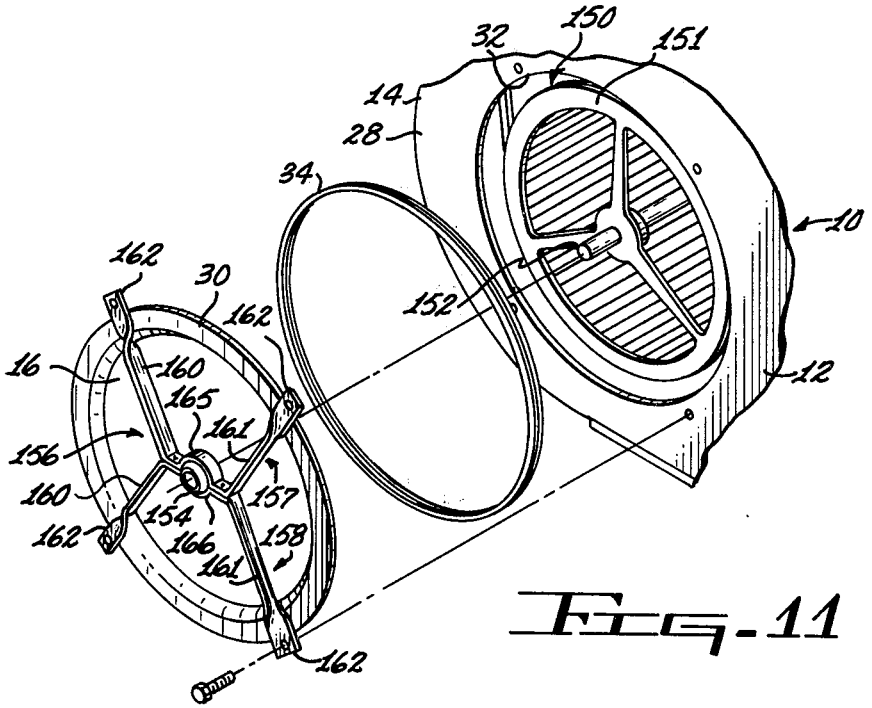
FIG. 11 is a fragmentary isometric view similar to FIG. 1 and partially exploded to show the various features of another embodiment of the centrifugal blower assembly of the present invention.
Figure 12:
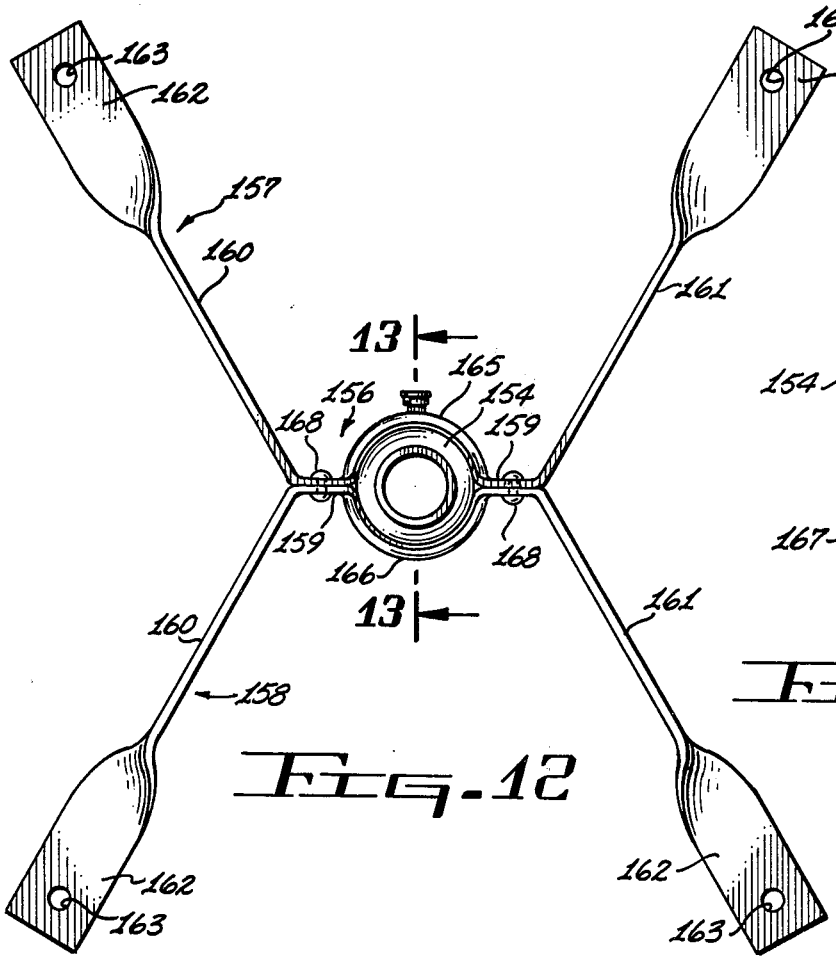
FIG. 12 is a side view of the rotor support brace shown in FIG. 11.
Figure 13:
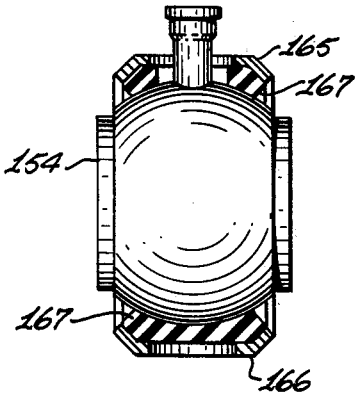
FIG. 13 is an enlarged sectional view taken on the line 13—13 of FIG. 12.

Referring now to FIGS. 11, 12, and 13 wherein yet another modification of the present invention is shown. In this embodiment, the rotatable air moving rotor assembly 150 includes a peripherally driven blower wheel 151 to which an axle shaft 152 is axially affixed for rotation therewith. This basic type of rotor assembly is well known in the art, and a particular rotor of this type is fully disclosed in U.S. Pat. No. 3,746,464, issued July 17, 1973 to the same inventor.

The rotor assembly 150 is mounted within the centrifugal blower housing 12 which, as previously described, may be provided with at least one access panel means 30 for improving the serviceability of the centrifugal blower assembly.

When the centrifugal blower assembly is provided with a pair of axial air inlets as previously described, the rotor assembly 150 is supported and journaled for rotation in a spaced pair of suitable bearings 154 (one shown) which are carried in an identical pair of rotor support braces 156 (one shown). Since the braces 156 (one shown) are identical, the following description will be understood to be typical. The rotor support brace 156 includes a first, or upper strap member 157 and a second, or lower strap member 158. The strap members 157 and 158 are identical and are each provided with a central portion 159 which is integral with and intermediate a pair of oppositely angularly diverging strut portions 160 and 161. The extending ends of the strut portions are each twisted approximately 90 degrees to provide a mounting pad 162 thereon, with each of the pads having an aperture 163 formed therethrough. The strap members 157 and 158 are positioned so that their respective central portions 159 are in abutting engagement with each other so that the strut portions extend radially from the abutting central portions 159. The upper strap member 157 is provided with an upwardly upset semicircular portion 165 formed at the midpoint of its central portion 159, and the lower strap member 158 is provided with an oppositely upset semicircular portion 166. When the strap members 157 and 158 are placed so that their respective central portions 159 are in abutting engagement, the upset portions 165 and 166 thereof form a circular member for retaining the bearing 154.

The bearing 154 may be of any suitable type, with the bearing that is shown being of the self aligning type due to the spherical configuration of its outer housing. Such bearings are well known in the art and usually include a capillary bronze bushing which is lubricated from a reservoir provided within the housing, and having a suitable oil filler tube.

Mounting of the bearing 154 within the circular retainer provided by the straps 157 and 158 may include the use of a grommet 167 as is customary in the art, and the central portions 159 of the straps are affixed to each other with suitable fasteners 168 such as rivets. Other means for affixing the straps 157 and 158 may be employed such as suitable bolts and nuts (not shown), spot welding (not shown), and the like.

The low cost easily fabricated rotor support braces 156 (one shown) may be employed in conjunction with conventional centrifugal blower housing, i.e., without the access panel means 30 formed therein, and such an installation could be accomplished by simply bolting the braces 156 (one shown) to the opposite one piece sides of the housing.

As shown in FIG. 11, the rotor support brace 156 may be attached to the access panel means 30 such as by welding, so that the brace 156 and the panel 30 form a one piece structure for simplified mounting and removal thereof.

It may now be seen that the previously described rotor support braces 110 and 156 are very similar to each other in that they both are formed of relatively low cost strap material and are formed in essentially the same manner. Thus, the same basic materials, dimensions, tooling, and fabrication techniquest can be employed in fabrication of those braces. The design of the braces in themselves lends to the low cost and versatility thereof, for example, the four point mounting feature provides exceptional rigidity thus allowing the use of relatively thin gage strap material. Further, the central portions 159 of brace 156 is unique in that any desired strap interconnection technique 4 may be employed, such as the rivets 168 (or spot welding) when bearing replacement capability is not needed, and bolts (not shown) when such capability is desirable.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A centrifugal blower assembly comprising:

(a) a blower housing having a side wall in which an air inlet opening is formed;

(b) a rotor support brace attached to the side wall of said blower housing so as to span the air inlet opening formed therein;

(c) a stub shaft mounted on said rotor support brace and extending therefrom coaxially through the air inlet opening formed in the side wall of said blower housing and into the interior thereof;

(d) a rotor assembly positioned within said blower housing so as to be coaxial with the air inlet opening formed in the side wall thereof, said rotor having one of its opposite ends supported on said stub shaft and journaled for rotation about said stub shaft; and (e) said rotor support brace comprising, a first strap member configured to provide a flat portion intermediate a pair of oppositely angularly diverging strut portions, a second strap member configured to provide a flat portion intermediate a pair of oppositely angularly diverging strut portions, said first and said second strap members having their flat portions in abutting engagement with each other and having said stub shaft affixed thereto and extending laterally therefrom, and each of the strut portions of said first and said second strap members twisted adjacent its extending end to form a mounting pad thereon.

2. A centrifugal blower assembly as claimed in claim 1 wherein said stub shaft comprises:

(a) said stub shaft having a longitudinally extending bore formed therein which is closed at one end and open at its opposite end, said stub shaft having at least one radial aperture formed therein which communicates between the bore and the peripheral surface thereof;

(b) means mounted in the open end of the bore of said stub shaft for closing that open end; and (c) means within the bore of said stub shaft for retaining a lubricant and dispensing that lubricant through the radial aperture of said stub shaft.

3. A centrifugal blower assembly as claimed in claim 1 and further comprising, an access panel means forming a part of the side wall of said blower housing, said access panel means being demountable to allow access to the interior of said blower housing for servicing purposes, said access panel means circumscribing the air inlet opening formed in the side wall of said blower housing.

4. A centrifugal blower assembly as claimed in claim 1 wherein said rotor comprises:

(a) at least one blower wheel having an axially disposed hub assembly; and (b) bearing means mounted in at least one end of said hub assembly of said blower wheel for rotatable journaling said rotor on said stub shaft.

5. A centrifugal blower assembly as claimed in claim 1 wherein the side wall of said blower housing comprises:

(a) a fixed panel portion having an access opening formed therein to provide servicing access to the interior of said blower housing; and (b) an access panel portion demountably positioned within the access opening formed in said fixed panel portion, said access panel portion circumscribing the air inlet opening formed in the side wall of said blower housing.

6. A centrifugal blower assembly as claimed in claim 5 wherein said access panel portion is affixed to said rotor support brace.

7. A centrifugal blower assembly as claimed in claim 5 wherein the access opening formed in the fixed panel portion of the side wall of said blower housing is larger than the diameter of said rotor to allow said rotor to pass through that access opening.

8. A centrifugal blower assembly as claimed in claim 5 and further comprising:

(a) the access opening formed in said fixed panel and said access panel being of substantially circular configuration;

(b) an annular flange formed on said fixed panel on the edge thereof which circumscribes the access opening formed therein; and (c) an annular gasket in engagement with the periphery of said access panel and in engagement with said annular flange for forming an airtight rattle free seal between said access panel and said fixed panel.

* * * * *